United States Patent [19]

Sardella

[11] Patent Number: 4,889,331

[45] Date of Patent: Dec. 26, 1989

[54] ROTARY-TYPE FEEDER MACHINES AND METHODS

[75] Inventor: Louis M. Sardella, Cockeysville, Md.

[73] Assignee: Prime Technology, Inc., Hunt Valley, Md.

[21] Appl. No.: 936,953

[22] Filed: Dec. 1, 1986

Related U.S. Application Data

[63] Continuation of Ser. No. 674,294, Nov. 23, 1984, abandoned.

[51] Int. Cl.[4] ..... B65H 5/06

[52] U.S. Cl. ..... 271/11; 271/94; 271/105; 271/112; 271/114; 271/118; 271/132; 271/135

[58] Field of Search ..... 271/35, 105, 112, 114, 271/118, 131–133, 135, 136, 11, 23, 90, 94

[56] References Cited

U.S. PATENT DOCUMENTS

| | | | |
|---|---|---|---|
| 407,985 | 7/1889 | Woodard . | |
| 963,946 | 7/1910 | Saunders | 271/115 |
| 976,640 | 11/1910 | Cowles . | |
| 978,702 | 12/1910 | Cowles . | |
| 1,092,437 | 4/1914 | Ferguson . | |
| 2,280,964 | 4/1942 | Mixer | 271/23 |
| 2,394,410 | 2/1946 | Tascher . | |
| 2,819,898 | 1/1958 | Cote . | |
| 2,936,909 | 5/1960 | Gard | 271/131 |
| 3,193,282 | 7/1965 | Stewart . | |
| 3,252,702 | 5/1966 | Halbert . | |
| 3,392,973 | 7/1968 | Ward et al. . | |
| 3,406,963 | 10/1968 | Goss . | |
| 3,486,749 | 12/1969 | Billings | 271/114 |
| 3,588,093 | 6/1971 | Ward, Jr. et al. . | |
| 3,588,095 | 6/1971 | Ward, Jr. et al. . | |
| 3,612,512 | 10/1971 | Lang . | |

(List continued on next page.)

FOREIGN PATENT DOCUMENTS

| | | | |
|---|---|---|---|
| 649976 | 10/1962 | Canada | 271/115 |
| 1183100 | 12/1964 | Fed. Rep. of Germany . | |
| 1393037 | 5/1964 | France . | |
| 2269416 | 11/1975 | France . | |
| 839920 | 6/1960 | United Kingdom . | |

OTHER PUBLICATIONS

Lou Sardella, "The Rotary Feed," pp. 53–57.

Production Committee of the Corrugated Containers division, Technical Association of the Pulp and Paper Industry (TAPPI), "The State of the Art of Feeders," TIS 0305-50, pp. 1–5 (1985).

"Shur-Feed" sales brochure, 1 page.

*Primary Examiner*—Richard A. Schacher

*Attorney, Agent, or Firm*—Saidman, Sterne Kessler & Goldstein

[57] ABSTRACT

A rotary feeder feeds sheets or board-like articles to nip rolls in a box-making machine. The boards are successively and individually fed from the bottom of a stack whose forward edge engages a gate below which the boards are fed by driven feed members such as wheels, rolls or endless belts which engage the underside of the lowermost board. To raise and lower the boards relative to the surface of the feed members, a vertically reciprocable grate is provided between the drive members. The grate and drive members are mounted in a vacuum box in which a vacuum is established to hold the boards in proper position on the feed members when the grate is lowered. The vacuum is also utilized to hold the boards with sufficient force to produce necessary friction between the boards and the feed members for feeding. The feed members are driven through an oscillating rocker shaft and gearing in two opposite directions, one of which serves to convey the boards below the gate to the nip rolls and the other of which serves to relieve pressure of the board against the gate prior to conveyance to the nip rolls. The grate is actuated through oscillatable shafts connected to the grate and driven from a cam and cam-follower assembly which, in turn, is driven from a crank gear that is also employed to drive the rocker shaft through a linkage or quick return slide mechanism. A latch device is also provided to releasably hold the grate in raised position above the feed members to interrupt the feeding operation.

21 Claims, 6 Drawing Sheets

U.S. PATENT DOCUMENTS 3,680,855 8/1972 Brown et al. .
3,731,915 5/1973 Guenther ..... 271/114
3,785,640 1/1974 Delcano et al. ..... 271/136
3,941,372 3/1976 Matsuo .
3,944,215 3/1976 Beck ..... 271/115
4,045,015 8/1977 Sardella .
4,128,236 12/1978 Lundblad .
4,181,298 1/1980 Capdeboscq .
4,236,708 12/1980 Matsuo .
4,363,478 12/1982 Tsukasaki .
4,494,745 1/1985 Ward et al. ..... 271/95
4,614,335 9/1986 Sardella .
4,681,311 7/1987 Sardella ..... 271/35 X

6

BOARD
TRAVEL
32
55
b
46
36a
18
50
50
50
51
52a
37
52
34
35
36
40
8
40
35
10
34
8

ROTARY-TYPE FEEDER MACHINES AND METHODS

This application is a continuation of application Ser. No. 674,294, filed Nov. 23, 1984 now abandoned.

BACKGROUND OF THE INVENTION

The present invention generally relates to box-making machinery wherein a plurality of blanks or boards or sheets are successively fed along a horizontal path to stations along the path where various operations are performed, for example, printing, cutting, slotting, folding, gluing, etc. More specifically, the present invention relates to methods and apparatus for successively feeding the boards or sheets to a pair of nip rolls which then feed the boards to the stations where the various above-indicated operations are performed.

There, of course, exists in the prior art various box-making machines including feeding mechanism for successively feeding the boards to nip rolls preliminary to the box-making operations to be performed on the boards. One conventional feeding mechanism referred to in the art as a "kicker feed" utilizes a reciprocating pusher bar which engages the rear or trailing edge of the board and pushes the board to the nip rolls. Once the board is engaged by the nip rolls, the pusher bar is returned to its starting position to engage the next board and push it to the nip rolls. The pusher bar is reciprocated through a rocker shaft which is driven from the main power source of the machine. Examples of such kicker feed mechanisms are disclosed in U.S. Pat. Nos. 3,392,973, 3,588,093 and 3,588,095.

Although a kicker feed mechanism has the advantage of being driven through a rocker shaft system which is relatively inexpensive, reliable and capable of providing high torque outputs as may be needed, it is thought by some to possess certain problems from the standpoint of safety and operation. For example, with a kicker feed, the kicker bar or pusher must be carefully controlled in order to squarely feed the blank in proper registry with the nip rolls. Moreover, the trailing edge of the sheet or board being fed must be carefully controlled to insure proper engagement with the feed lips of the kicker bar. Also, if the board or sheet is warped, it may become jammed due to the rear edge feed. Additionally, thin or low-strength sheets may not be able to withstand the column loading applied by the kicker bar.

In an attempt to avoid the above problems with kicker feeds, another type of feed, namely a "rotary feed", has been developed and used in industry. By way of example, it is noted that rotary-type feeders are disclosed in U.S. Pat. Nos. 4,363,478, 4,045,015, 976,640 and 978,702. With a rotary-type feed, the sheet or board is engaged by underlying rotating members or endless belts and is fed thereby to the nip rolls adjacent the leading edge area of the sheet. Such feeding obviates the rear edge feeding problems of kicker feeds while also utilizing a simple vacuum system to hold the board down on the feed members. One drawback, however, of a rotary feed system is that heretofore it has required the use of an indexing or geneva-type drive for driving the feed members, which drive is more complicated, expensive and possesses less torque capability than the rocker shaft system used with kicker feeds. The torque capacity of the drive limits the surface area of the rotary feed members which affects the engagement and consequently the feeding of the boards in the manner desired.

Moreover, an indexing or geneva drive is not as versatile as a rocker shaft drive in adapting to various torque requirements of different box making or other machines.

Another problem which has attended various feed mechanisms of the prior art including kicker feeds or rotary-type feeds is that the leading edges of the sheets or boards at times become jammed against the gate at which they are stacked, making it difficult to lower the sheet onto the support surface for conveyance by the feed mechanism to the nip rolls.

OBJECTS OF THE PRESENT INVENTION

An object of the present invention is to provide a novel method and apparatus for feeding articles such as blanks, sheets or boards such as for example, in a box-making machine and which overcome the above-noted problems and/or limitations of feeder mechanisms and methods of the prior art.

Another object of the present invention is to provide an improved rotary-type feeder mechanism for feeding articles such as boards, sheets or blanks. Included herein is an improved rotary-type feeder mechanism which utilizes a rocker shaft drive system for driving the feed members. Included herein is such a rotary-type feeder mechanism which may be driven from a rocker shaft drive of a conventional box-making machine. Also included herein is an improved rotary-type feeder mechanism which may be easily incorporated into new or existing conventional box-making machinery.

A further object of the present invention is to provide a novel method and apparatus for feeding sheets, boards, blanks or like articles from the bottom of a stack in a box-making machine or the like without jamming the articles against a gate below which the articles are fed.

A still further object of the present invention is to provide a rotary feeder mechanism for feeding articles such as blanks, sheets or boards and which includes a novel interrupter mechanism for interrupting feeding of the articles.

SUMMARY OF THE INVENTION

In summary, a rotary type feeder mechanism according to a preferred embodiment of the invention includes feed members which may be feed wheels, rolls or endless belts that are driven from an oscillating rocker shaft and gearing including a rocker gear connecting the rocker shaft to a gear train that drives the feed members in one of two opposite directions by frictional engagement to nip rolls, to feed sheet or board articles resting thereon. The articles are successively fed from the bottom of a stack overlying the feed members behind a gate. A grate is provided between the feed members for lowering the bottom article in the stack onto the feed members for feeding and for raising the article from the feed members after the article is received in the nip rolls. The feed members are mounted in the upper portion of a vacuum box which supplies a vacuum to hold the articles on the feed members in proper position. The vacuum is also utilized to hold the boards with sufficient force to produce necessary friction between the boards and the feed members for feeding.

Once the lowermost article has been fed out from below the stack, the direction of the feed members is reversed and the grate is lowered to engage the next lowermost article in the stack. In accordance with the invention, the reverse direction of the feed members while the article is resting thereon occurs for only a short duration sufficient to relieve the pressure on the gate exerted by the lowermost article to thereby avoid jamming of the article. The direction of the feed members is then reversed to feed the article to the nip rolls after which the cycle is repeated.

In one preferred embodiment, the grate is raised and lowered in the desired timed sequences by means of shafts that are operatively connected to the grate to drive them up and down upon oscillation of the shafts. Such oscillation is achieved by a cam and cam follower assembly driven from gearing including a crank gear that is also employed to oscillate the rocker shaft through a linkage or quick return slide mechanism. The cam which controls the cam follower has a high dwell surface engageable by the cam follower to determine the raised position of the grate above the upper surfaces of the feed members and a low dwell surface engageable by the cam follower to determine the lowered position of the grate below the upper surfaces of the feed members. The crank gear may be driven from the main power source of the associated machine and in the preferred embodiment, this drive is taken from one of the nip rolls.

In accordance with another feature of the invention, the grate may be held by a novel device above the feed members to interrupt the feeding operation. This device is a latch including in the preferred embodiment an aperture in a lever which holds the cam follower employed to oscillate the grate actuating shafts as described above. The latch further includes a pin which is actuated such as by a small air cylinder into the aperture when the cam follower engages the high dwell surface of the cam which surface determines the raised position of the grate above the upper surface of the feed members as described above. In order to release the grate to resume the feeding operation, the air cylinder is actuated to retract the pin from the aperture in the cam follower lever thereby freeing the latter for normal operation. Other features of the invention appear in the more detailed description below.

DRAWINGS

Other objects and advantages of the present invention will become apparent from the following more detailed description of the drawings in which.

Figure 5:
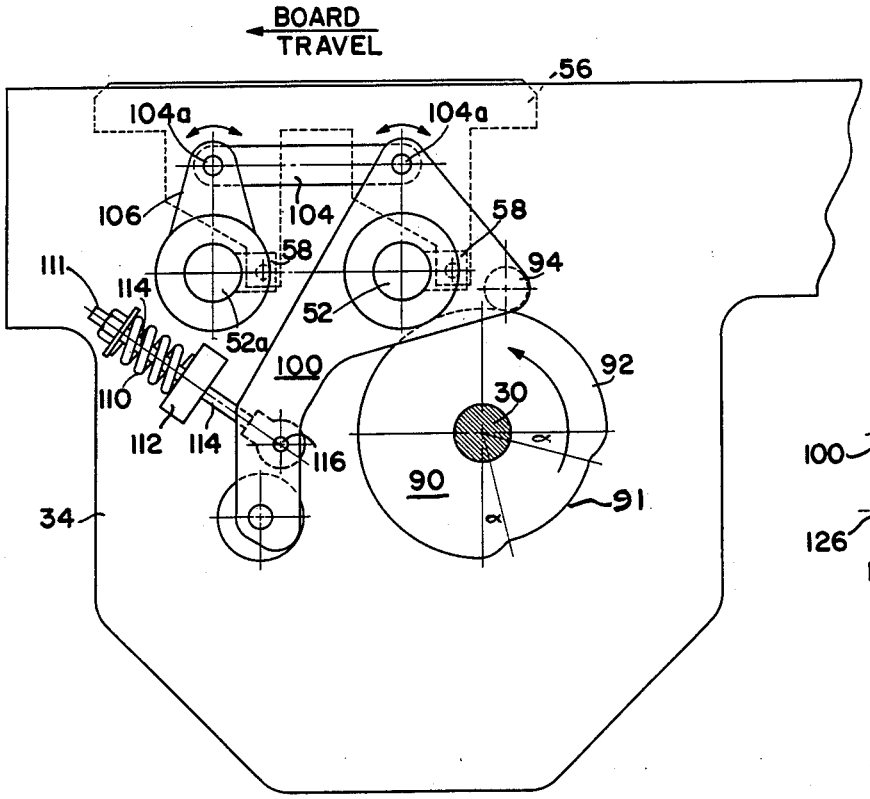
FIG. 5 is a fragmental side elevational view as seen from the front side of the feeder mechanism and showing a cam and cam follower assembly which is utilized to drive a grate included in the feeder mechanism.
Figure 5A:
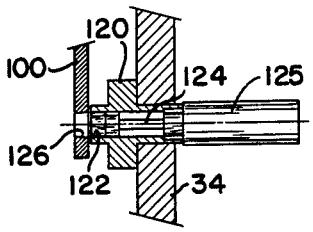
Figure 7:
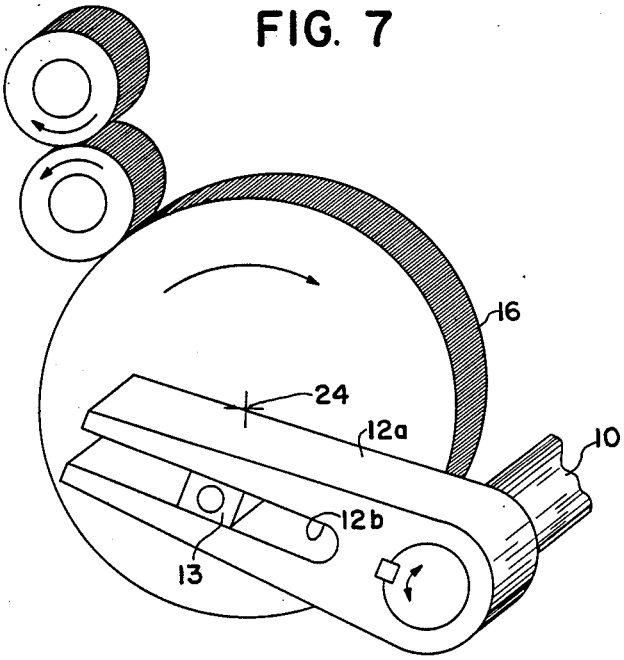
Figure 6:
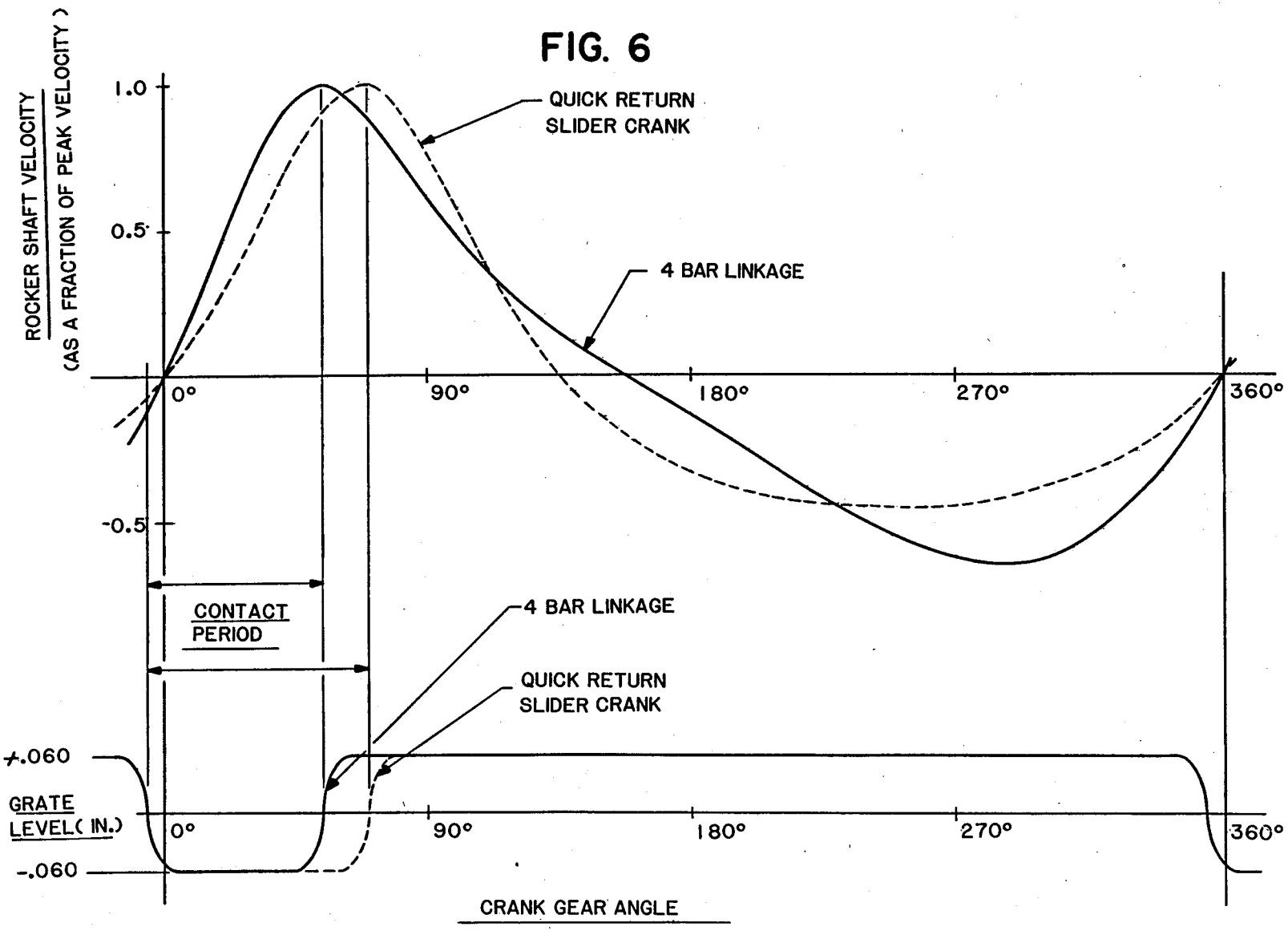

FIG. 5*a* is a detailed cross-sectional view showing a latch device incorporated in the feeder mechanism for interrupting the feeding operation;

FIG. 6 is a graph illustrating the relationship between the velocity of the feeder members and the position of the grate included in the feeder mechanism; and FIG. 7 is a perspective view of a quick return slider assembly that may be substituted for a linkage according to another embodiment of the invention.

DETAILED DESCRIPTION

Figure 1:
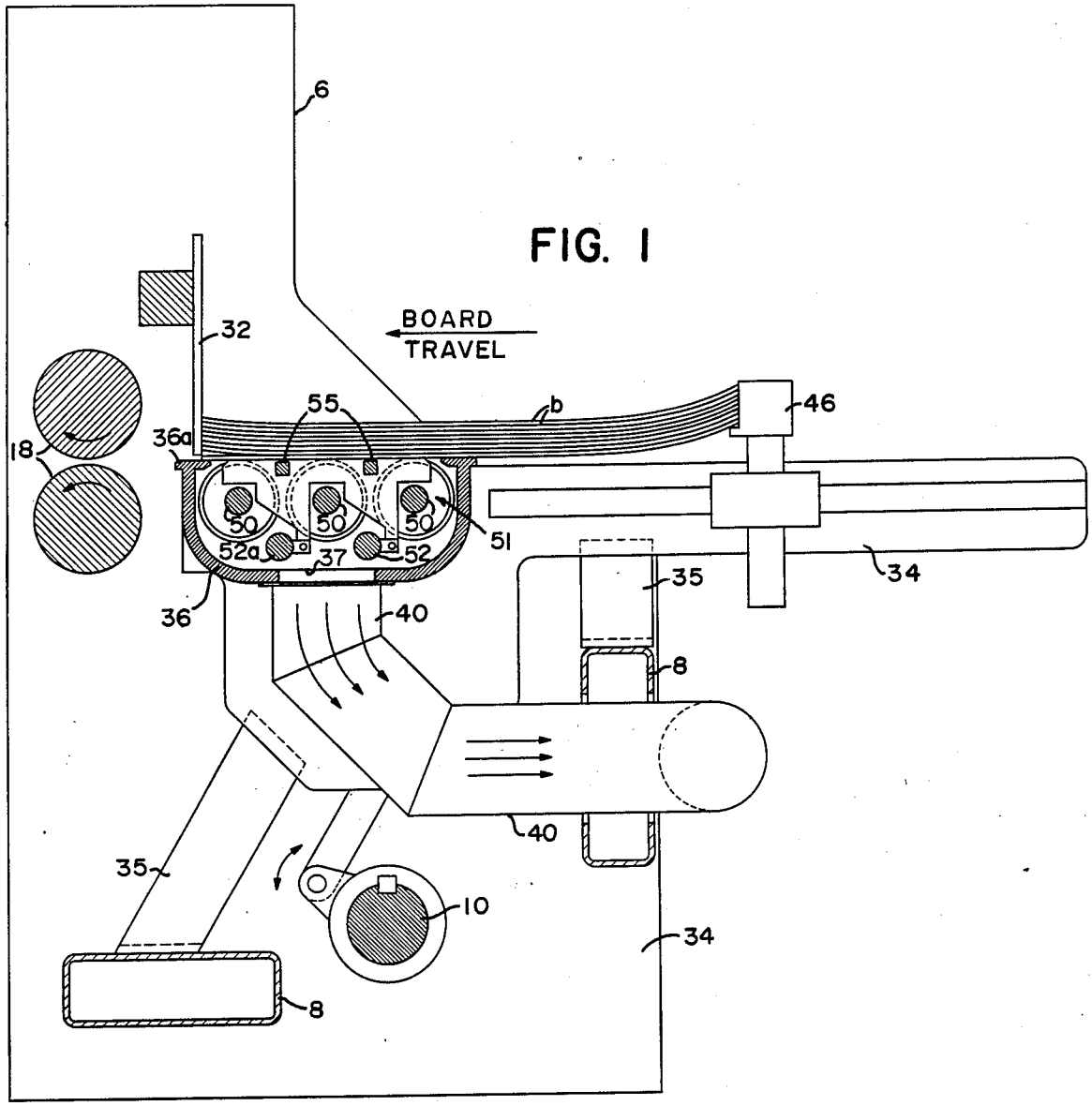
FIG. 1 is a front elevational view of a feeder mechanism constituting a preferred embodiment of the present invention and with certain parts shown in cross section.

Referring to the drawings in detail and initially to FIG. 1, there is disclosed apparatus embodying the invention for feeding paperboard blanks such as corrugated blanks or sheets, generally designated b, one-by-one to the nip of feed rolls 18 suitably mounted in a main frame 6 which forms part of box-making machinery including other mechanisms for printing, cutting, slotting, folding or gluing and the like which are not shown. The boards b are, of course, flat and are stacked one on top of the other in a suitable hopper with the lowermost board resting on a feed surface 36*a* which extends horizontally in the plane between the feed rolls 18. The forwardmost edges of the boards are positioned by one or more gate members 32 (one shown) and by a trailing edge support generally designated 46 having a lower ledge on which the rearmost edges rest. The gates 32 and the trailing edge support 46 are adjustable in the lengthwise direction of the machine to accommodate boards of different lengths. Additionally, they are adjustable in vertical planes so as to precisely set the distance between the lowermost edge of the gate 32 and the feed surface 36. Additionally, vertical adjustability of the trailing edge support 46 is employed to compensate for warpage occurring in any of the boards. The feed surface 36*a* is formed by the upper surface of a vacuum box 36 which encloses a vacuum chamber supplied with a vacuum through a duct 40 connected to any suitable source of vacuum and which communicates with the vacuum chamber through apertures 37 formed in the bottom wall of the vacuum box 36 as best shown in FIG. 3.

Figure 2:
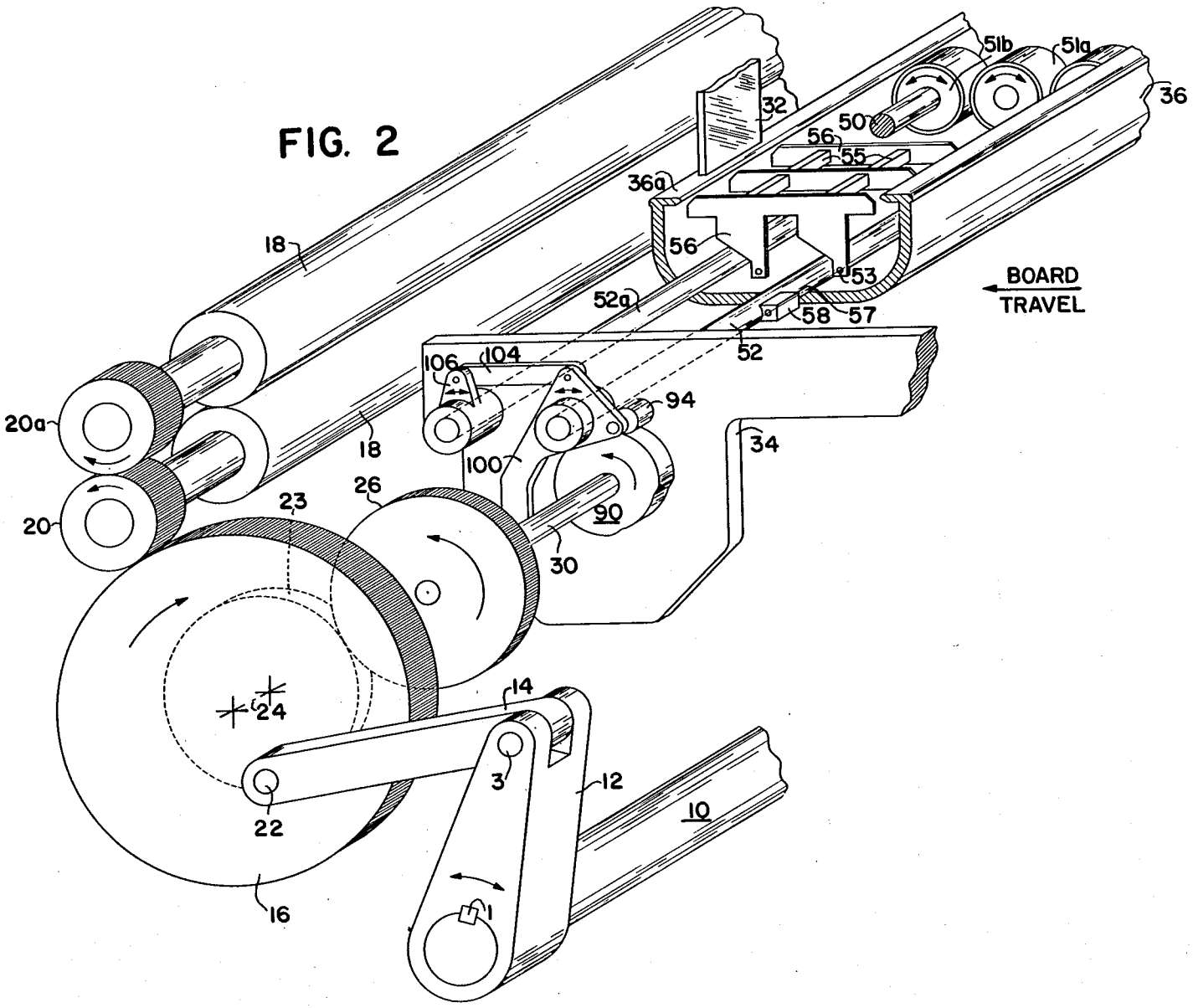
FIG. 2 is a perspective view of portions of the feeder mechanism as would be seen from the front side thereof and with certain parts shown in cross section and other parts removed for clarity.
Figure 3:
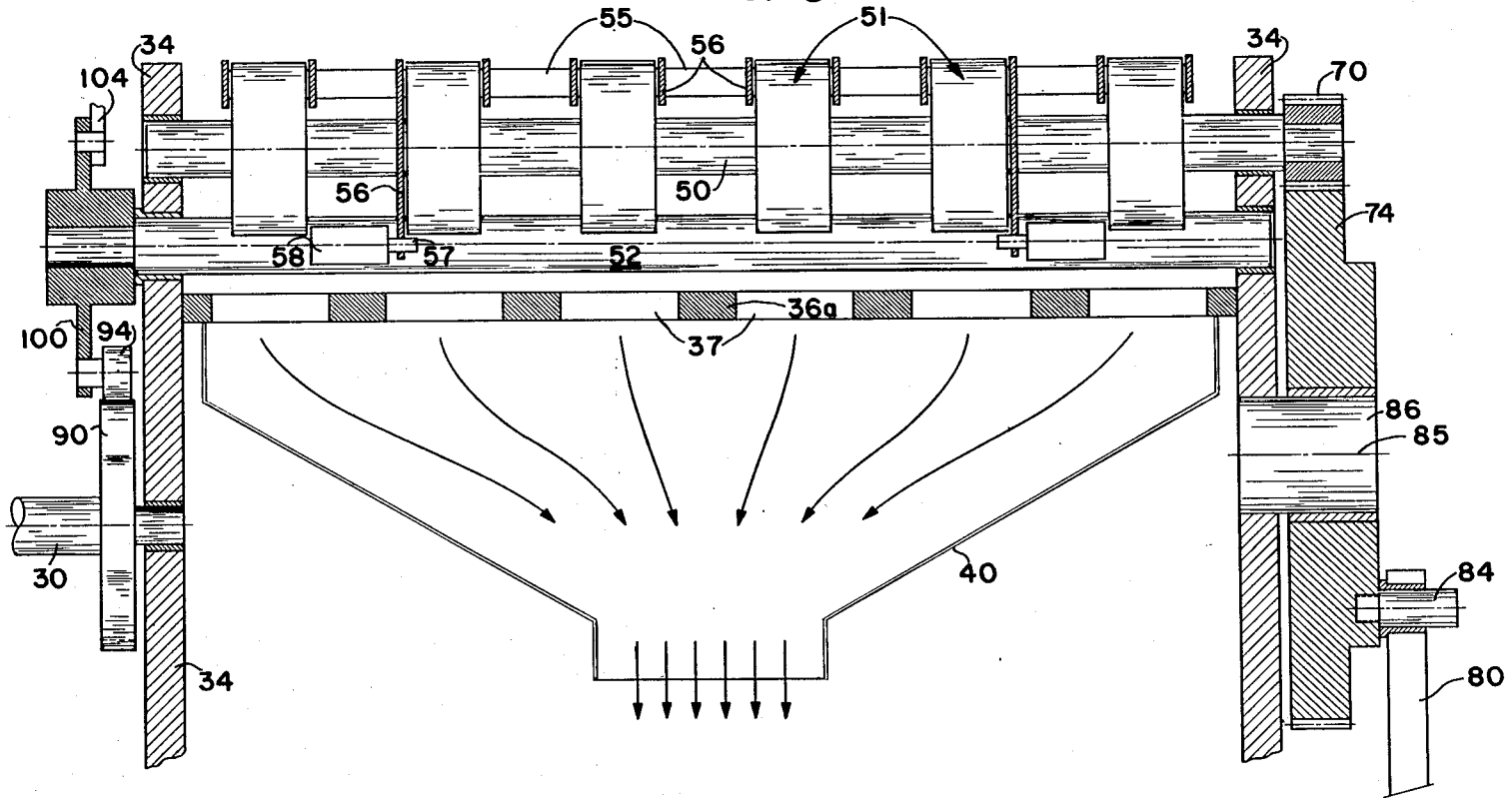
FIG. 3 is a cross-sectional view taken along lines extending transversely of the feeder mechanism and with certain parts removed.

The boards b are fed one-by-one across the feed surface 36 and into the nip of the feed rolls 18 by means of a plurality of driven feed wheels generally designated 51 mounted for rotation in the vacuum chamber of the vacuum box 36 on shafts 50 which are journaled for rotation in opposite end frame members 34 (see FIG. 3). In the specific embodiment shown, there are three rows of feed wheels 51 extending transversely of the longitudinal or feeding direction of the machine with each row containing ten feed wheels and with the feed wheels in adjacent rows being aligned with each other in the longitudinal or feeding direction of the machine. The feed wheel shafts 50 run parallel to each other and are equally spaced from each other, and the feed wheels in each of the rows are uniformly spaced from each other. The feed wheel shafts 50 are geared to rotate in opposite directions to drive the feed wheels in forward or reverse directions for a purpose to be described below. As seen in FIG. 2, feed wheels 51 are provided with a high friction outer cylindrical surface 51*a* formed from any suitable material such as rubber or urethane so that the coefficient of friction between the feed wheel surfaces and the boards b will be in the range of 0.7 to 1.0. The friction surface 51*a* may be provided on aluminum hubs 51*b* or any other suitable construction may be employed.

In order to raise and lower the boards b off and on to the feed wheels 51 for purposes which will be explained below, a grate is provided to extend between the feed wheels throughout the extent of the feed wheels. Referring to FIGS. 1 and 2, the grate includes a plurality of vertical ribs 56 formed by plate-like structures of any suitable material, such as steel, which extend parallel to each other between the feed wheels 51 and the longitudinal or feeding direction of the machine. Extending between and fixed to the ribs 56 are a plurality of rod members 55 which are recessed slightly downwardly from the upper surface of the ribs 56 as best shown in FIGS. 2 and 3.

The grate 55, 56 is mounted and actuated up and down in the vertical direction at the desired time by means of preferably two elongated shafts 52 and 52*a* which extend transversely of the machine through the vacuum box 36 below the level of the feed wheels and which are journaled at their opposite ends in the frame members 34 at opposite sides of the machine. Shafts 52 and 52*a* each contain mounting lugs 58 fixed thereto and having pins 57 receivable in apertures 53 fixed to depending leg portions of certain grate ribs 56 as best shown in FIG. 2. By structure to be described below, shafts 52 and 52*a* are rotatable in small amounts in opposite directions in order to raise or lower the grate 55, 56. When the grate 55, 56 is in its lowered position shown in FIG. 1, the upper surface of the grate is below the upper surfaces 51*a* of the feed wheels which are thus able to contact the underside of the board b to drive it by friction. When the grate is in its raised position, its upper surface is above the upper surfaces 51*a* of the feed wheels whereby the board b is out of contact with the feed wheels which occurs after the board b is engaged and driven by the nip rolls 18.

The vacuum box 36 with the feed wheels, grate and grate mounting and actuating means, and the side frame members 34 may be provided as a unit into existing machines or, of course, new machines. Referring to FIG. 1, this is effected by mounting the frame members 34 onto cross-frame members 8 of the existing machine through means of struts 35 fixed to and between frame members 34 and cross-frame members 8. Cross-frame members 8 are fixed in the main frame 6 which is shown in FIG. 1.

Figure 4:
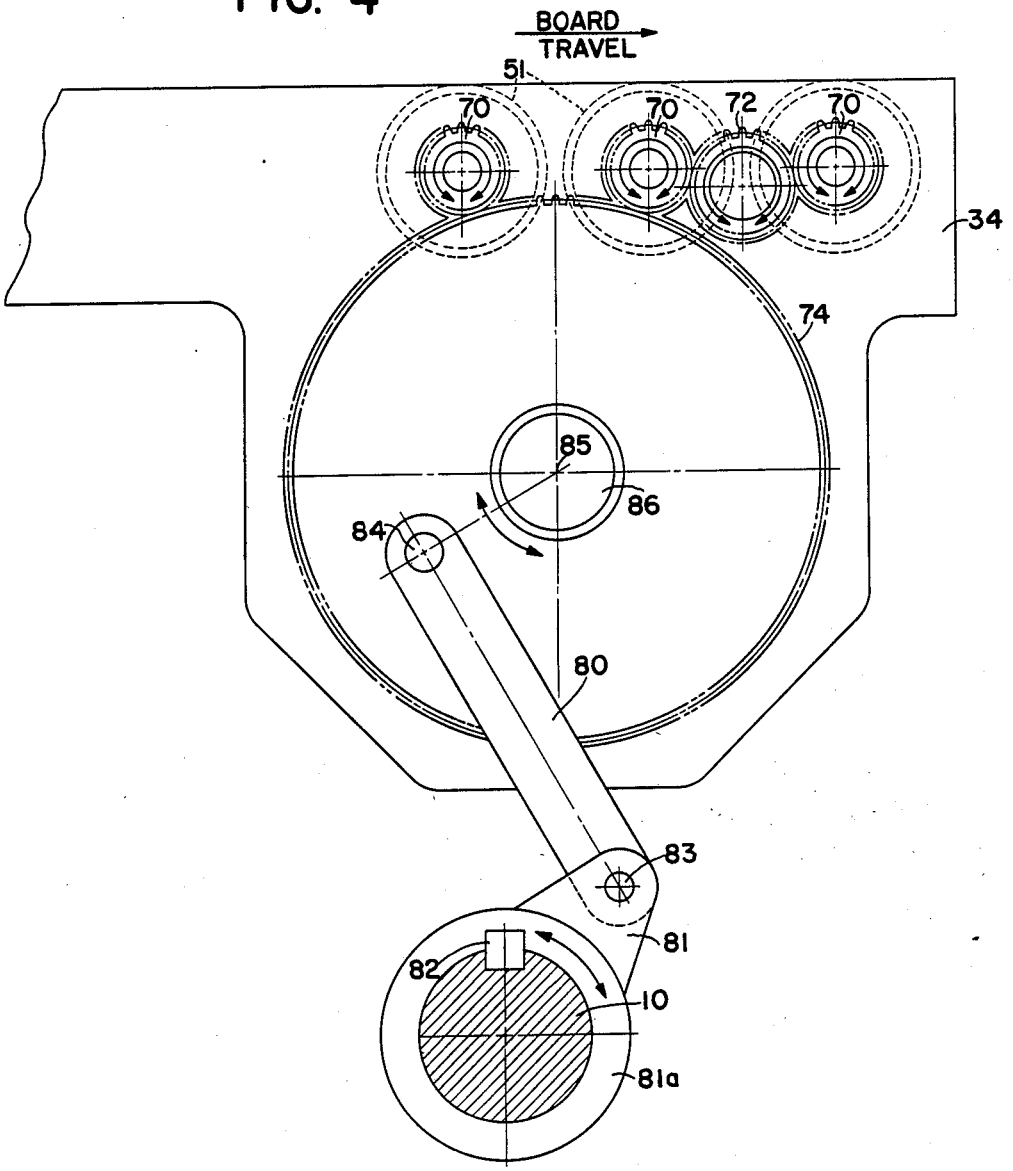
FIG. 4 is a fragmental side elevational view as seen from the rear side of the feeder mechanism and showing a drive system for actuating feed members of the feed mechanism.

Referring to FIG. 4, feed wheels 51 are driven in opposite rotative directions about the axis of their shafts 50 through mechanism including a plurality of wheel gears 70 fixed to shafts 50 on one of the ends thereof located outwardly of frame 34 (see FIG. 3). Two of the wheel gears 70 are in mesh with a much larger gear 74 to be driven thereby while the remaining wheel gear 70 is driven through means of an idler gear 72 in mesh with two of the wheel gears 70 as shown in the right-hand side of FIG. 4. As shown in FIG. 3, rocker gear 74 is mounted at its center 85 on a pivot shaft 86 which is journaled in frame 34.

In accordance with the present invention rocker gear 74 is rotatably oscillated about its axis 85 by means of a rocker shaft 10 and a linkage operatively interconnecting rocker shaft 10 and rocker gear 74. In the specific embodiment shown in FIGS. 2, 3 and 4, a mechanism is employed which is the equivalent of a four-bar linkage, the mechanism including a rocker arm 81 fixed to and projecting from a sleeve 81*a* which, in turn, is mounted about rocker shaft 10 and fixed thereto by means of a key 82 as best shown in FIG. 4. The mechanism further includes a connecting link 80 pivotally connected at one end at pivot 83 to the rocker arm 81 and pivotally mounted at its opposite end by pivot 84 to the rocker gear 74 at a location offset from the axis 85 of the rocker gear 74 as best shown FIG. 4. This action of the feed wheels 51 and their actuation through the linkage and the rocker shaft is to be contrasted with conventional feed wheels that are driven in one rotative direction by a geneva or indexing drive.

It will be seen that upon rotation of rocker shaft 10 in one direction, the feed wheels 50 will be rotated in one direction, and upon rotation of the rocker shaft 10 in the opposite direction, feed wheels 50 will be rotated in the opposite direction. The forward rotational direction of the feed wheels 51 is of course, utilized to drive the boards b to the nip rolls 18 when the grate is in its lower position. In accordance with the invention, the reverse or rearward rotational direction of the feed wheels 51 is utilized to urge the board b away from the gate 32 to relieve pressure against the gate 32 and prevent jamming. This latter action occurs at the end of the reverse rotation phase of the feed wheels when the grate is lowered and just prior to the forward rotational phase of the feed wheels 51 which serves to feed the board b to the nip rolls 18.

Referring now to FIG. 2, rocker shaft 10 is driven by means of a crank gear 16 which in turn is driven by a gear 20 which, in turn, is driven from the main drive of the associated box-making machinery (not shown). Gear 20 is fixed to the shaft of one of the feed rolls 18 while being in mesh with another feed roll gear 20*a* which is fixed to the shaft of the other feed roll 18, whereby feed rolls 18 are driven in counterdirections for feeding the boards b into box-making machinery. Crank gear 16 drives rocker shaft 10 in oscillation by means of a mechanism which amounts to a four-bar linkage including a first link generally designated 12 which may be termed a "feed lever" having a passage therein receiving rocker shaft 10 and being fixed thereto through means of a key 1. The mechanism further includes a connecting link 14 having one end pivotally connected by a pivot 3 and having its opposite end pivotally connected by a pivot 22 through the crank gear 16 at a location offset from the axis of rotation 24 of the crank gear 16. It will therefore be seen that rotation of the crank gear 16 by feed roll gear 20 will cause rocker shaft 10 to oscillate through means of the linkage mechanism including links 12 and 14.

Referring to FIG. 7, the rocker shaft 10 may be driven by a quick return slider crank instead of the linkage 12, 14 described above. As shown in FIG. 7, this mechanism includes a slider 12*a* keyed to rocker shaft 10 and having an elongated slot 12*b* receiving a block 13 pivoted to crank gear 16 to slide in slot 12*b*. Block 13 is, of course, mounted to crank gear 16 at a location offset from the center 24 of crank gear 16. It will be seen that rotation of crank gear 16 will function to oscillate rocker shaft 10 by virtue of the action of the slide 12*a*.

Referring now to FIGS. 2 and 5, shafts 52 and 52*a* are rotatably oscillated in small increments in order to raise and lower the grate 55, 56 and such action is achieved through a cam 90 and cam follower lever 100, 94 which is driven from a gear 26 (see FIG. 2) which, in turn, is driven from a gear 23 that is fixed concentrically to the inner surface of crank gear 16 so as to be rotatable therewith. Cam 90 is fixed to a shaft 30 which is journaled in the frame member 34 and which is fixed to gear 26 at the center axis thereof so as to be driven thereby. Referring to FIG. 5, cam 90 has a circumferential surface portion 92 which may be termed "the high-dwell surface" and a shorter circumferential surface portion 91 which may be termed "the low-dwell surface" extending between the high-dwell surface 90 with transitional surface portions extending therebetween for the extent of the angle $\alpha$. The cam follower lever includes a dog leg portion 100 having a hub receiving the end of shaft 52 to which it is suitably keyed for movement therewith. On one side of dog lever 100 is a cam follower or roller 94 which engages on the surface of cam 90. The other shaft **52*a* is operatively connected to be oscillated in small increments in unison with shaft 52 through means of a link 104, whose opposite ends are pivotally connected by pivots 104*a* to the dog leg lever 100 and to a follower lever 106 fixed to shaft 52*a* by means of a hub received about shaft 52** and keyed thereto in any suitable manner.

It will be seen that when cam follower 94 engages the high-dwell surface 90, the grate will be at rest in an elevated position and when the cam follower 94 engages the low-dwell surface 91, the grate will be at rest in a depressed or lowered position. Additionally, when the cam follower surface 94 engages the transition surface enclosed by the angle $\alpha$, that is, between the high-dwell and low-dwell surfaces 90 and 91, the cam follower will be lowered or raised depending on the particular transition surface engaged which, in turn, will slightly rotate the dog leg lever 100 and, in turn, the associated shaft 52 to actuate the grate 55 and 56. Motion of the dog leg lever 100 is transmitted to the adjacent shaft **52*a* through means of the link 104 and follower lever 106 to rotate shaft 52*a* in unison with shaft 52. In the latter regard, dog lever 100, link 104 and follower lever 106 act as a parallelogram linkage with the pivots of the parallelogram linkage lying at 52, 104*a* and 52*a***.

Referring now to FIG. 5 cam follower 94 is urged onto the surface of cam 90 by a spring mechanism including a coil compression spring 110 having one end bearing against a block 112 fixed to the frame 34 and having an opposite end bearing against a nut and washer assembly 111 received about a rod 114 which extends through the axis of the coil spring 110 and through the block 112 after which it is pivotally connected by pivot 116 to the dog leg lever 100 as shown in FIG. 5. It will be seen that spring 110 urges the rod 114 in the direction to impose a clockwise (as viewed in FIG. 5) bias on dog leg lever 100 which, of course, urges cam follower roller 94 into engagement with the surface of cam 90.

In order to interrupt the feeding of the boards b, it is necessary to position the grate 56 spaced above the feed wheels 51, that is, when the cam follower 94 is engaged on the high-dwell surface 92 of the cam 90. For this purpose, a latch mechanism in accordance with another aspect of the invention is provided. As shown in FIG. 5A in the preferred embodiment, the latch mechanism includes an aperture 126 formed in the lower leg portion of dog leg lever 100 for receiving a pin 122 that is mounted for reciprocal movement in a housing 120 fixed in the frame 34. Housing 120 has an elongated passage receiving a rod 124 of an air cylinder 125 with the pin 122 being fixed to the extremity of the rod 124. When the cam follower is positioned on the high-dwell surface 92 of cam 90, the aperture 126 in dog leg lever 100 will be aligned with pin 122 whereupon if it is desired to interrupt the sheet feeding by virtue of the grate 56 being positioned above the feed wheels 51, air cylinder 124 is energized to extend pin 122 into the aperture 126. When received in the aperture 126, the latch pin 122 holds the cam follower 94 at the level of the high dwell surface of the cam 90 which thus maintains the grate in the raised position regardless of the rotation of cam 90. When in its raised position, the grate prevents contact of the boards with the feed wheels 51 and thus feeding of the boards is interrupted. Only a small air cylinder 124 is needed to actuate pin 122 and therefore such action occurs quickly and efficiently to interrupt sheet feeding at precisely the desired point. When sheet feeding is to be resumed, air cylinder 125 is actuated to retract pin 122 from aperture 126 in the dog leg lever 100, thereby freeing the latter for operation as described above. The latter must be effected when the cam follower is positioned above the high-dwell surface.

FIG. 6 shows two graphs which illustrate the relationship of the velocity of the feed wheels 51 to the position of the grate 55, 56 throughout a full cycle of operation. The upper graph shows the relationship of rocker shaft (10) velocity versus crank gear (16) angle while the lower graph shows grate level versus the crank gear angle. The solid lines in the graphs refer to the embodiment of FIGS. 1 to 5 utilizing a four-bar linkage to drive the rocker shaft 10 while the dotted lines refer to the embodiment which utilizes a quick return slider crank shown in FIG. 7 to drive the rocker shaft 10. The contact period shown in the graphs refers to the phase when a board b is contacting the feed wheels 51. Note, however, that the smaller portion of the contact period (during negative velocity) occurs when the feed members 51 are rotating in a reverse direction which is utilized, as indicated above, to relieve the pressure of the board b against the gate 32. That is to say that the positive velocity values depicted on the graph refer to rotation of the feed wheels 51 in the forward or board-feeding direction, while the negative velocity values refer to the rotation of the feed wheels in the reverse direction. Additionally, the positive values for the grate level refer to when the grate is above the surface of the feed wheels 51 while the negative values refer to when the grate is below the surface of the feed wheels.

It will therefore be seen from FIG. 6 that when the feed members are increasing velocity during the contact period, the grate 55, 56 is in its lowered position and therefore, the board is being conveyed to the nip rolls 18. As the feed wheels 51 approach their peak velocity, the board begins to enter the nip rolls 18 and the grate begins to rise. The board enters the nip rolls near the point at which the feed wheels 51 reach a peak velocity which is matched to the constant velocity of the nip rolls. After the board is engaged in the nip rolls, the grate rises above the surface of the feed wheels 51 after which the grate reaches its uppermost level as the feed wheels decelerate and the board is being conveyed by the nip rolls 18 off the surface of the grate. The grate remains in its elevated position when the velocity of the feed wheels 51 changes from positive to negative (when the direction of the feed wheels 51 is reversed). However, at the end of this reversing phase of the feed wheels as they approach zero velocity, the grate begins to lower until the next board to be fed engages the feed wheels 51 at a very low negative velocity at which time the reversing feed wheels function to urge the board away from the gate 32 to relieve pressure until the feed wheels come to zero velocity and then rotate in the forward direction to drive the board toward the nip rolls 18. The above cycle is then repeated. The board is displaced the distance from gate 32 to the nip rolls 18 to arrive at the same velocity as the nip rolls by virtue of the proper selection of the four bar linkage and gear ratio shown in FIG. 4 as described above. The grate is lowered and raised at the appropriate time as described above and this timing is governed by the length of the low-dwell surface 91 and the extent of transition angle $\alpha$ which are selected accordingly. At any time during the relatively long phase when the grate is elevated, if it is desired to interrupt the cycle of operation, the air cylinder 125 (FIGS. 5 and 5*a*) need only be actuated to extend latch pin 122 into aperture 126 of cam follower lever 100 which will thus hold the grate in the elevated position. When it is desired to resume operation, the air cylinder is actuated to retract latch pin 122 from the cam follower lever 100 during the same relatively long phase when the grate is elevated.

It will be seen that among its several advantages described above, the feeding mechanism of the present invention not only employs a conventional rocker shaft to drive the feed wheels in two opposite directions, but also it may be easily adjusted to various new or existing box-making machine drives to provide the desired timing, sequencing and torques by substituting different size linkages between the rocker shaft 10 and the rocker gear 74 or between the crank gear 16 and the rocker shaft 10. This is a clear advantage over the indexing or geneva drive systems heretofore employed with rotary feeders which systems are more complex and require the substitution of different gears or gear arrangements in order to adapt to different drive systems. Additionally, it will be appreciated that the rocker shaft drive utilized by the present invention will provide sufficient torque capacity to enable larger surfaces to be utilized on the feed wheels 51 to increase speed and accuracy of feeding.

It should be pointed out that although the preferred embodiment of the invention described and illustrated above utilizes feed members in the form of rotatable wheels or rolls, the present invention may alternatively utilize other types of feed members such as, for example, endless belts that move in horizontal paths below the boards to be fed. Therefore, it should be understood that the term "rotary feeder" as used herein is not limited to the specific rotatable feed members 51 that will perform in accordance with the teachings of the present invention.

What is claimed is:

1. In an apparatus for feeding corrugated boards and the like from beneath a stack behind a gate and wherein the articles are individually fed under the gate along a generally horizontal path; the improvement comprising: rotatable feed members movable in a first direction to engage and move the lowermost article in the stack towards said gate and along said path, said feed members being movable in a second direction opposite to said first direction for urging the lowermost article away from said gate, without bending the article, prior to movement of the article under the gate, means for driving said feed members in both of said first and second directions, means for causing said feed members to come into and out of contact with the stack and wherein said feed members have surfaces frictionally engageable with the underside of the lowermost article to move the article through frictional engagement therewith along said path and under said gate upon movement of said feed members in said first direction, the stack remaining in a relatively fixed horizontal position during the movement of said lowermost article and said feed members in both said first and second directions.

2. The apparatus defined in claim 1 wherein said driving means includes an oscillatable rocker shaft.

3. The apparatus defined in claim 2 wherein said driving means further includes a rocker gear driven by said rocker shaft and gear means operatively interconnecting said rocker gear and said feed members.

4. The apparatus defined in claim 3 wherein said driving means further includes a link connected to said rocker shaft and pivotally connected to said rocker gear eccentrically of the axis of said rotation of the rocker gear.

5. The apparatus defined in claim 4 wherein said feed members are rotatable wheels.

6. In a feeder mechanism for use in a box-making machine or the like including a generally horizontal path of conveyance and a pair of nip rolls for conveying sheet-like articles along said path; the feeder mechanism including a vacuum box having an apertured upper surface along said path upstream of said nip rolls, a gate positioned above the vacuum box upstream of the nip rolls for containing the leading edges of articles to be fed under the gate to the nip rolls, and a grate mounted in the vacuum box for vertical movement above and below the path of conveyance; the improvement comprising in combination: a plurality of feed members mounted in the vacuum box for movement in a first direction and having surfaces to engage and feed an articles in a forward direction under said gate and to said nip rolls when the grate is in a lowered position below said surfaces of the feed members, said feed members being movable in a second direction opposite to said first direction for urging the article away from said gate, without bending the article, prior to movement of the article under the gate when the grate is in said lowered position, means for driving said feed members in both of said first and second directions, and means for moving the grate below said path during movement of said feed members in said second direction to urge the article away from said gate prior to movement under the gate.

7. The feeder mechanism defined in claim 6 wherein said driving means includes an oscillatable rocker shaft.

8. The feeder mechanism defined in claim 7 wherein said driving means further includes a rocker gear driven by said shaft and gear means operatively interconnecting said rocker gear and said feed members.

9. The feeder mechanism defined in claim 8 wherein said driving means further includes a link connected to said rocker shaft and pivotally connected to said rocker gear eccentrically of the axis of the rotation of the rocker gear.

10. The feeder mechanism defined in claim 9 wherein said feed members have surfaces frictionally engageable with the underside of the article to move the article along said path upon movement of said surfaces.

11. The feeder mechanism defined in claim 10 wherein said feed members are rotatable wheels.

12. The feeder mechanism defined in claim 6 wherein said feed members have surfaces frictionally engageable with the underside of the article to move the article along said path upon movement of said surfaces.

13. The feeder mechanism defined in claim 12 wherein said feed members are rotatable wheels.

14. In the feeder mechanism defined in claim 6, the improvement including means including an oscillatable shaft for driving the grate between upper and lower positions relative to the surfaces of the feed members, a pin fixed to a side of the shaft to oscillate therewith, said grate having a depending leg with an aperture therein receiving said pin to transmit motion from the oscillatable shaft to the grate.

15. In a feeder mechanism for use in a box-making machine or the like including a generally horizontal path of conveyance and a pair of nip rolls for conveying sheet-like articles along said path; the feeder mechanism including a vacuum box having an apertured upper surface along said path upstream of the nip rolls, a gate positioned above the vacuum box upstream of the nip rolls for containing the leading edges of articles to be fed under the gate to the nip rolls, and a grate mounted in the vacuum box for vertical movement above and below the path of conveyance; the improvement comprising in combination, feed means including at least one rotary feed member mounted in the vacuum box to feed articles in a forward direction under said gate and to said nip rolls when the grate is in a lowered position below surfaces of the feed member, and means for driving said feed means in a first direction to feed articles under said gate to the nip rolls, and in a second direction opposite to said first direction, said driving means including an oscillatable rocker shaft and means operatively interconnecting said rocker shaft and said feed means including a rocker gear, gear means operatively interconnecting said rocker gear and said feed means, and a link connected to said rocker shaft and pivotally connected to said rocker gear eccentrically of the axis of the rotation of the rocker gear.

16. The feeder mechanism defined in claim 15 wherein there is included a plurality of feed members in the form of rotatable wheels having peripheral surfaces frictionally engageable with the articles to feed the same, said wheels being positively driven in rotation in opposite directions in coordination with the position of the grate.

17. In the feeder mechanism defined in claim 16, the improvement including a second oscillatable shaft for driving the grate between upper and lower positions relative to the surfaces of the feed members, a pin fixed to a side of the second shaft to oscillate therewith, said grate having a depending leg with an aperture therein receiving said pin to transmit motion from the oscillatable shaft to the grate, and wherein both of said oscillatable shafts are driven in a predetermined sequence relative to each other from the same power source.

18. In a feeder mechanism for use in a box-making machine or the like including a generally horizontal path of conveyance and a pair of nip rolls for conveying sheet-like articles along said path; the feeder mechanism including a vacuum box having an apertured upper surface along said path upstream of said nip rolls, a gate positioned above the vacuum box upstream of the nip rolls for containing the leading edges of articles to be fed under the gate to the nip rolls, and a grate mounted in the vacuum box for vertical movement above and below the path of conveyance between raised and lowered positions, a plurality of feed members mounted in the vacuum box for movement to engage and feed articles in a forward direction under said gate and to said nip rolls when the grate is in the lowered position below surfaces of the feed members, and means for driving said grate between said raised and lowered positions including a cam having on its periphery a high-dwell surface determining the raised position of the grate and a low dwell surface recessed inwardly from the high dwell surface and determining the lowered position of the grate, and a cam follower engaged on the periphery of the cam and operatively connected to the grate to drive the same between the raised and lowered positions thereof, the improvement comprising a latch means for holding the cam follower at the level of the high-dwell surface of the cam to maintain the grate in the raised position thereof, said latch means including a latch member engageable with said cam follower to hold the cam follower at the level of the high-dwell surface of the cam, said latch member being disengageable with the cam follower to permit the cam follower to move between the high and low dwell surfaces of the cam, and wherein said latch means includes a lever holding the cam follower and containing an aperture, and the latch member is a pin movable into the aperture to hold the cam follower at the level of the high-dwell surface of the cam and the latch pin is movable out of the aperture to release the cam follower for the movement between high and low dwell surfaces of the cam.

19. The improvement defined in claim 18 further including means for driving said latch pin including a fluid motor having an extendable and retractable rod fixed to the latch pin to drive the same into or out of said aperture in the cam follower lever.

20. A method of feeding stacked, sheet-like articles one at a time from a relatively fixed horizontal position through a gate of a feeding apparatus while preventing jamming against the gate of the article being fed, the feeding apparatus including rotary feed members positioned under the stacked articles to engage same, comprising the steps of:

(a) rotating the feed members in a first direction to feed the lowermost article from the stack through the gate;

(b) vertically separating the stacked articles from contacting the feed members;

(c) reversing the direction of rotation of the feed members to rotate in a second direction opposite to the first direction;

(d) bringing the stacked articles back into contact with the feed members so that the lowermost article from the stack contacts the feed members rotating in the second direction and is thus moved away from the gate; and (e) repeating the foregoing steps (a)–(d).

21. Apparatus comprising means for feeding stacked, sheet-like articles one at a time from a relatively fixed horizontal position through a gate of a feeding apparatus while preventing jamming against the gate of the article being fed, the feeding apparatus including rotary feed members positioned under the stacked articles to engage same, comprising:

(a) means for rotating the feed members in a first direction to feed the lowermost article from the stack through the gate;

(b) means for reversing the direction of rotation of the feed members to rotate in a second direction opposite to the first direction; and (c) means for vertically separating the stacked articles from contacting the feed members prior to actuation of said reversing means and for bringing the stacked articles back into contact with the feed members so that the lowermost article from the stack contacts the feed members rotating in the second direction and is thus moved away from the gate prior to actuation of said means for rotating said feed members in said first direction and wherein said feed members remain in contact with the lowermost article until after actuation of said means for rotating said feed members in said first direction.

* * * * *